United States Patent [19]

Zimmer

[11] 3,986,450

[45] Oct. 19, 1976

[54] CLEANING ATTACHMENT FOR CYLINDRICAL PRINTING SCREEN

[76] Inventor: Peter Zimmer, Untere Sparchen 546, A 6330 Kufstein, Tirol, Austria

[22] Filed: Dec. 27, 1974

[21] Appl. No.: 536,897

[30] Foreign Application Priority Data

Dec. 28, 1973 Austria ..... 10876/73

[52] U.S. Cl. ..... 101/115; 101/116; 101/425

[51] Int. Cl.[2] ..... B41F 15/12; B41F 35/00

[58] Field of Search ..... 101/116, 119, 120, 425, 101/115, 114, 129; 15/256.51, 256.52

[56] References Cited

UNITED STATES PATENTS

| | | | |
|---|---|---|---|
| 2,648,088 | 8/1953 | Barley | 101/425 |
| 2,731,916 | 1/1956 | Koch | 101/425 |
| 2,792,780 | 5/1957 | Jacob | 101/119 |
| 3,693,547 | 9/1972 | Morgan | 101/425 |
| 3,785,286 | 1/1974 | Giori | 101/425 X |

FOREIGN PATENTS OR APPLICATIONS

| | | | |
|---|---|---|---|
| 2,040,567 | 2/1971 | Germany | 101/119 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A cylindrical printing screen, rotatable about a horizontal axis, rolls on a continuously moving substrate to be imprinted and is internally provided with an applicator forming a gap through which a printing dye can pass to the substrate along the nadir of the screen. A codirectionally rotating scraper roll continuously sweeps the descending part of the outer screen surface and is in turn contacted by a squeeze roller or a doctor blade for the removal of excess dye. A similar cleaning device, e.g. in the form of an elongate suction nozzle, may be disposed along the rising part of the inner screen surface. The scraper roll can be continuously irrigated with rinse water and may be mounted, together with one or more spray heads, on a swingable frame for disengagement from the printing screen.

8 Claims, 5 Drawing Figures

CLEANING ATTACHMENT FOR CYLINDRICAL PRINTING SCREEN

CROSS-REFERENCE TO RELATED APPLICATION

This application contains subject matter disclosed in my copending application Ser. No. 348,703 filed Apr. 6, 1973, since abandoned and replaced by application Ser. No. 538,560 filed Jan. 6 1975.

FIELD OF THE INVENTION

My present invention relates to a machine for imprinting textile fabrics and other substrates wherein a cylindrical screen, provided with pattern-forming apertures for the passage of dye-stuff from its interior to an underlying substrate, is rotatable about a horizontal axis and co-operates with an applicator forming a longitudinally extending gap at its bottom. As the cylinder rotates and the substrate to be imprinted advances simultaneously at a corresponding rate, a recurrent pattern is produced on that substrate.

BACKGROUND OF THE INVENTION

For multicolor printing, several such cylinders are disposed side by side above the substrate to produce complementary pattern components of different colors, the apertures of one screen then registering with areas of the substrate previously or subsequently contacted by solid surface portions of other screens. Such a composite pattern may have transverse strip zones in which a color component is completely absent so that the corresponding printing screen has an imperforate sector to register with these zones. The solid surface portions of certain screens in a row of such screens may therefore pick up differently colored dyestuff from previously printed areas of the substrate and allow the dye so picked up to penetrate through the apertures of the screen into its interior where it could adulterate the printing liquid already there. Furthermore, the dye adhering to the outer screen surface may stain parts of the substrate to be left blank or to be differently colored by another screen of the array.

Even with the first screen of the row there exists the risk that the outer screen surface becomes loaded with residual dyestuff trickling through its apertures along the ascending half of the screen, after passage of the printing gap, to form smudges on the following substrate areas contacted thereby. This applies also to machines using a single printing screen for producing a one-color pattern on a substrate whose length exceeds the circumference of the screen. Furthermore, screens of dielectric material tend to become charged by their frictional contact with the substrate and thus to attract lint and dust particles from the environment which thereafter stick to the freshly dyed substrate portions and mar their appearance.

OBJECTS OF THE INVENTION

The general object of my present invention is to provide means in such a printing machine for avoiding the aforedescribed drawbacks.

A more particular object is to provide means for ensuring clean lines of demarcation between differently colored components of composite patterns.

SUMMARY OF THE INVENTION

In accordance with my present improvement, I provide a cylindrical printing screen (or at least some of the screens of a row of such screens) with axially extending scraping or other cleansing means contacting or approaching a peripheral screen surface for the removal of adhering dyestuff and other matter therefrom.

In principle, such cleansing means may be positioned adjacent either or both peripheral screen surfaces, i.e. at the inside and/or the outside of the screen. For preventing outward leakage of dyestuff entrained by the rising screen portion, a cleansing device disposed along the ascending half of the inner screen surface will be suitable; such a device will also leave a cleaner screen surface when the screen is removed from its rotatable mounting for replacement with another pattern carrier. For the other purposes referred to, and in particular for preventing the smudging of the substrate with dye deposited thereon by one screen and picked up by another, cleansing device should be positioned externally of the associated screen, advantageously in such a way as to be disengageable therefrom to facilitate the dismounting and remounting of the screen.

In either case, the cleansing device may comprise an elongate suction nozzle extending over the entire effective length of the associated screen. A simpler solution, dispensing with the need for an exhaust pump or the like, resides in the provision of a preferably codirectionally rotating scraper roll continuously wiping the screen surface; such a roll may have an absorbing (e.g. cellular) structure, at least at its surface, and/or may coact with an adjoining squeeze roller designed to absorb excess dyestuff and to transfer it to a reservoir or sump. Instead of a squeeze roller I may use a doctor blade as a stripping means for removing excess dye from the surface of the scraper roll. Advantageously, pursuant to a further feature of my invention, such removal is assisted by a continuous irrigation of that roll.

Rotation may be imparted to the scraper roll by an independent motor, preferably of adjustable speed, or by a coupling such as a gear transmission between the scraper roll and the rotating screen or its mounting.

BRIEF DESCRIPTION OF THE DRAWING

The above and other features of my invention will now be described in detail with reference to the accompanying drawing in which.

SPECIFIC DESCRIPTION

Figure 1:
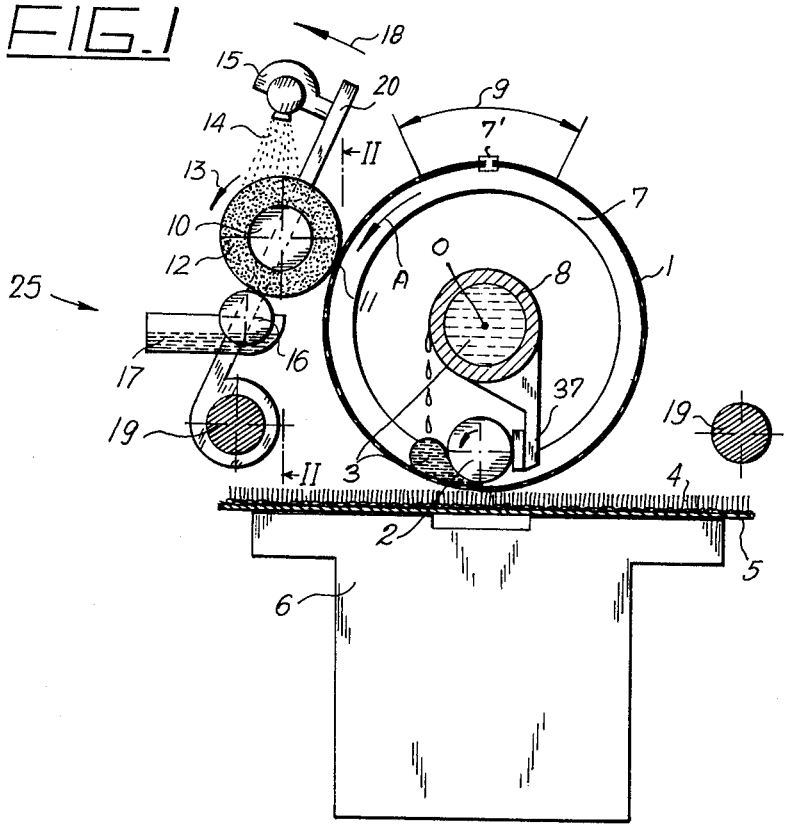
FIG. 1 is a somewhat diagrammatic cross-sectional view of a one-screen printing machine (or a stage of a multi-screen printing machine) embodying my invention.
Figure 2:
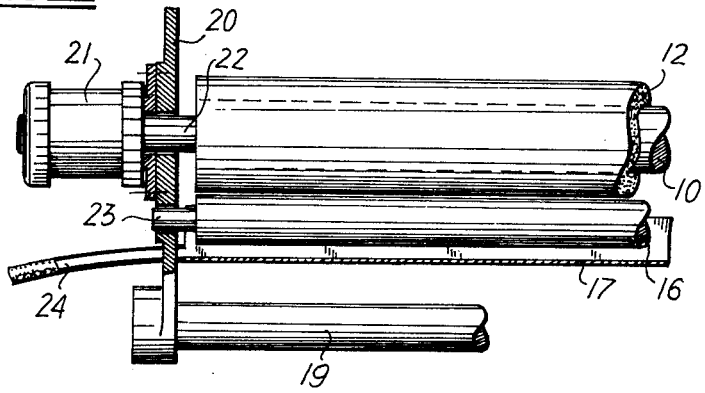
FIG. 2 is a partial side-elevational view of a scraper roll and an associated squeeze roller substantially as seen on the line II — II of FIG. 1.

Reference will first be made to FIGS. 1 and 2 showing a cylindrical printing screen 1 rotatable around a horizontal axis O; screen 20 is supported on a pair of axially spaced mounting rings 7 which are conventionally journaled on non-illustrated bearings and whose toothed rims 30 (see FIG. 4) are engaged by driving pinions, not shown, setting the screen 1 in unidirectional rotation about axis O as indicated by an arrow A, i.e. counterclockwise as viewed in FIG. 1. The two end rings 7, held together in the usual manner by a longitudinal rib 7', are traversed without contact by a horizontal tube 8 forming a reservoir for a printing liquid or dye to be selectively deposited on a substrate 4, such as a textile web, moving across a supporting plate 5 on a base 6 forming part of the machine frame. This frame also includes sidewalls (not shown) interconnected by transverse stays 19. Tube 8 is slitted or apertured to dispense the liquid 3 at a regulated rate into the interior of the rotating drum constituted by screen 1 and rings 7 to form a pool at the bottom of that drum, near the nadir of the cylindrical screen, immediately upstream of an applicator 2 in the shape of a round bar held against a stationary stop 37. As illustrated in FIG. 5, bar 2 may be biased downwardly by a set of axially spaced electromagnets 29 (only one shown) in base 6. Bar 2 overlies a printing gap defined by a pair of shutters 33, 34 which are carried on respective arms 33', 34' mounted on tube 8; arm 34', normally rectracted from arm 33', is swingable toward the latter upon a loosening of a clamp 36 to close the printing gap during standstill of the machine, as more fully described in my applications Ser. Nos. 348,703 and 538,560.

Figure 3:
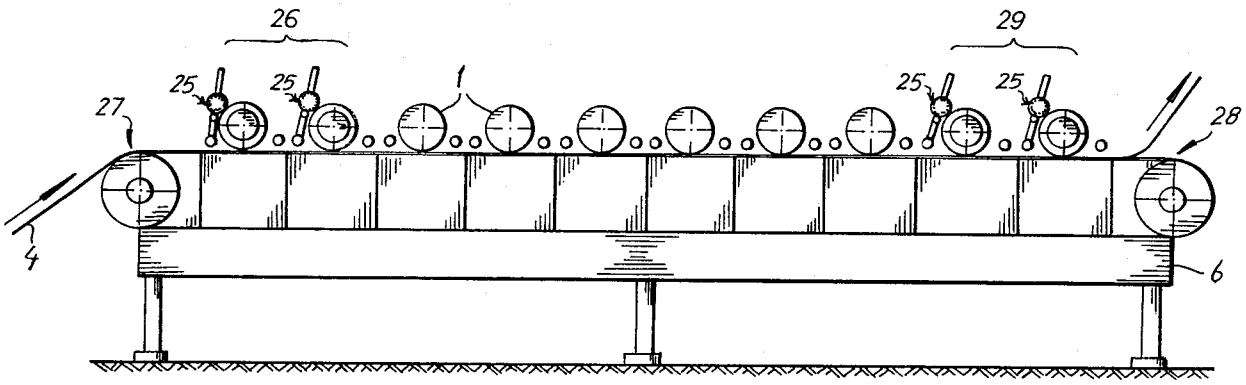
FIG. 3 is a schematic side-elevational view of a multistage printing machine incorporating the construction of FIGS. 1 and 2.

The greater part of the surface of screen 1 is apertured to form a pattern, this screen also having an imperforate zone 9 which in the position of FIG. 1 happens to lie across its zenith and which is bisected by the connecting rib 7'. Upon continuing rotation, zone 9 registers with an area of substrate 4 to which dyestuff has already been applied or is to be applied subsequently by another printing stage in a multistage machine as shown in FIG. 3. During movement of the screen sector 9 past the printing gap formed between shutters 33 and 34, i.e. once per revolution, the drum may be automatically lifted off the substrate 4 as is well known per se. Despite this precautionary measure, surface portion 9 might come into contact with previously imprinted and still wet areas of the substrate so as to pick up some of the dyestuff deposited on these areas and to smudge other parts of the substrate.

This risk is avoided, in accordance with my present invention, by the provision of an assembly 25 including a scraper roll 10 positioned alongside the screen 1 and in contact therewith along a line 11, roll 10 being continually rotated by a motor 21 about a horizontal axis parallel to drum axis O. The sense of rotation (counterclockwise in FIG. 1) is the same for screen 1 and roll 10, as indicated by an arrow 13, so that the two cylindrical surfaces are in relative motion along their line of contact 11. Roll 10 has an outer jacket 12 of absorbent material, e.g. foam rubber or felt, which picks up any liquid dyestuff adhering to the outer screen surface and discharges it into a trough 17 as a result of pressure exerted upon it by an adjoining squeeze roller 16. Scraper roll 10 and squeeze roller 16 are provided with respective shafts 22 and 23 which, as seen in FIG. 2, are journaled in a pair of symmetrically disposed levers 20 (only one shown) pivoted on one of the stays 19. Thus, the assembly 25 can be swung outwardly, as indicated by an arrow 18 in FIG. 1, to disengage the scraper roll 10 from the screen 1. FIG. 2 also shows a drain 24 for the discharge of the removed dyestuff.

In order to facilitate the scraping process and to keep the dyestuff liquid, I prefer to provide above scraper roll 10 an elongate spray head 15 (or a series of axially spaced spray heads) discharging a continuous stream 14 of a diluent such as water upon the top of the scraper roll around which the adhering matter removed from the outer peripheral surface of screen 1 is carried to the receptacle 17.

The yieldable surface layer 12 of roll 10 cannot penetrate into the perforations of screen 1 and does not injure its delicate printing surface. Instead of being porous, the coating 12 could also be made of nonabsorbent elastic material, such as soft rubber, as illustrated at 12' in FIG. 5. The latter Figure further shows the continuous removal of excess dye from the surface of roll 10 by a doctor blade 16', replacing the squeeze roller 16, which slopes toward a trough 17'; in this instance, too, the scraper roll 10 can be continuously irrigated.

In FIG. 3 I have shown a row of printing cylinders 1 for producing a multicolor pattern on a substrate 4 which enters the array of printing stages at 27 and leaves it at 28. Two stages 26 near the inlet and two stages 29 near the outlet are shown provided with scraping units 25 generally similar to that illustrated in FIGS. 1 and 2. Naturally, every one of these stages could be associated with such a scraping unit.

Figure 4:
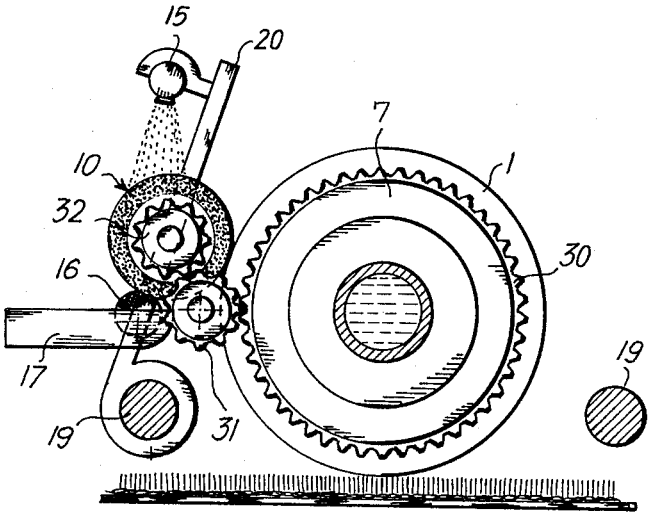
FIG. 4 is a view generally similar to FIG. 1, illustrating a modification.
Figure 5:
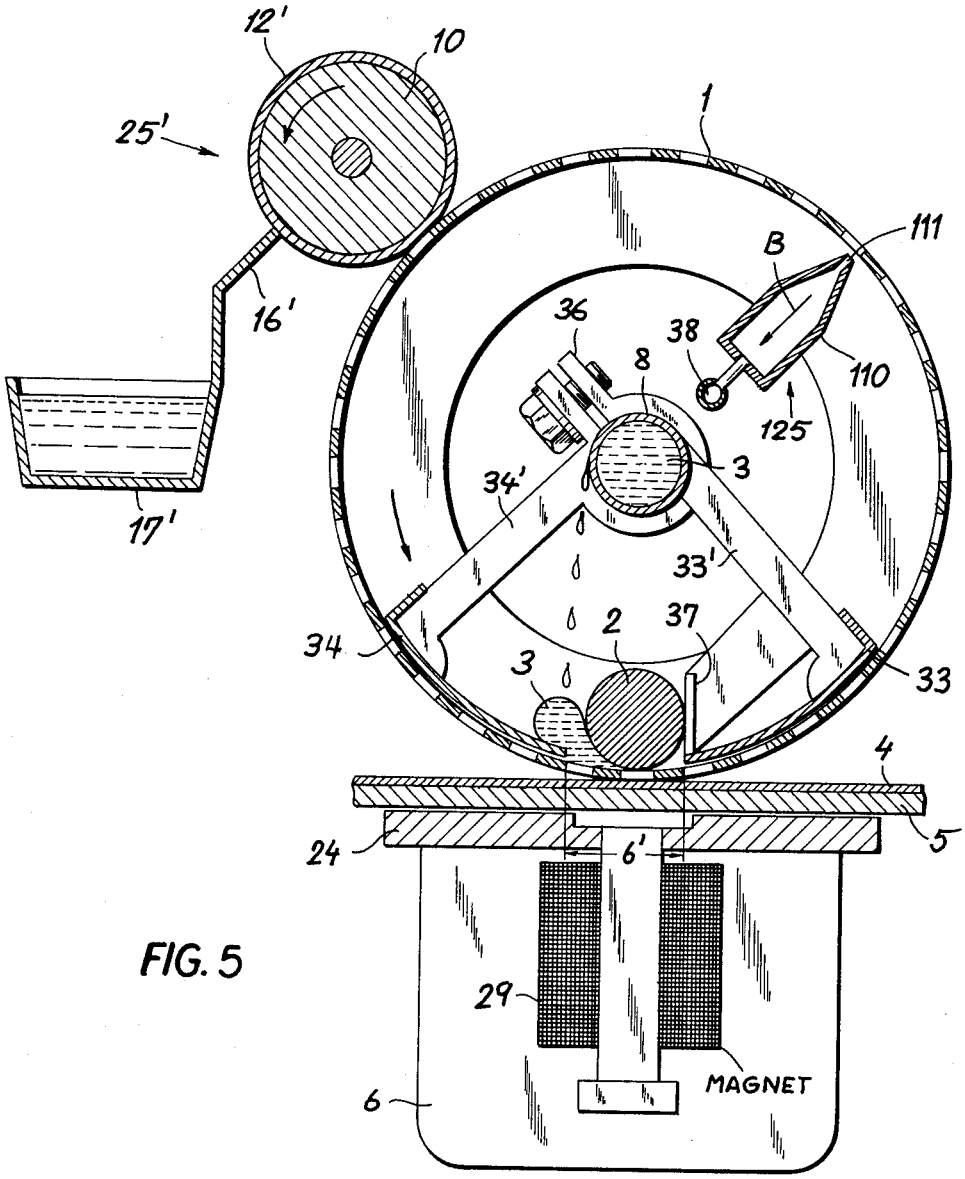
FIG. 5 is another view similar to FIG. 1, showing the present improvement applied to a printing maching of the type disclosed in my above-identified applications Ser. Nos. 348,703 and 538,560.

As illustrated in FIG. 4, motion may be imparted to a scraper roll 10 by a mechanical coupling including a pinion 31 meshing with the teeth 30 of mounting ring 7 and driving a gear 32 rigid with roll 10. Such a coupling has the advantage that the speed of the scraper roll is proportional to that of the screen 1 and is therefore commensurate with the rate of dye removal required at different operating speeds. The same result could be obtained indirectly through a servocontrol for the motor 21 of FIG. 2 responsive to the screen velocity.

In FIG. 5 I further show a cleansing device 125, disposed at the ascending half of the inner screen surface, supplementing a unit 25' for scraping the descending part of the outer screen surface. Unit 125 comprises an elongate nozzle 110 closely approaching the screen along a horizontal line 111, the interior of the nozzle being subjected to suction from a nonillustrated vacuum pump or a venturi via a tube 38 as indicated by an arrow B. Nozzle 110 removes residual dyestuff from the inner screen surface so that the same is relatively clean on being dismounted from the rings 7. A similar nozzle could, of course, also replace the scraper roll 10 of the external unit 25 or 25'.

I claim:

1. In a printing machine comprising an apertured cylindrical screen rotatable about a horizontal axis, applicator means forming a longitudinally extending gap at the bottom of said screen for the passage of dyestuff to an underlying substrate, and drive means for rotating said screen about said axis with concurrent displacement of said substrate for imprinting the latter according to a pattern formed by the apertures of said screen, the improvement wherein said screen is provided with axially extending cleansing means contacting said screen above the level of said gap for removing adhering matter from at least one peripheral screen surface, said cleansing means including a scraper roll with a resilient surface contacting a descending part of an outer peripheral screen surface, motion-imparting means for rotating said scraper roll codirectionally with said screen whereby said resilient surface moves upwardly adjacent said descending part and carries said adhering matter around the top of said scraper roll, spray means for irrigating the top of said scraper roll with a diluent, a receptacle positioned beneath said scraper roll to receive said adhering matter together with said diluent from said roll, and stripping means contacting a lower portion of said roll between said spray means and said screen for detaching said adhering matter from said resilient surface above the bottom of said receptacle.

2. The improvement defined in claim 1 wherein said stripping means comprises an absorbent squeeze roller.

3. The improvement defined in claim 1 wherein said stripping means comprises a doctor blade.

4. The improvement defined in claim 1 wherein said motion-imparting means comprises a motor independent of said drive means.

5. The improvement defined in claim 1 wherein said motion-imparting means comprises a mechanical coupling between said screen and said scraper roll.

6. The improvement defined in claim 1 wherein said resilient surface is formed by a coating of absorbent material.

7. The improvement defined in claim 1 wherein said cleansing means is provided with a mounting frame swingably secured to a support for said screen for enabling disengagement of said scraper roll from said peripheral screen surface, said spray means being carried on said frame above said scraper roll.

8. In a printing machine comprising a row of apertured cylindrical screens rotatable about parallel horizontal axes, applicator means forming a longitudinally extending gap at the bottom of each screen for the passage of dyestuff to an underlying substrate, and drive means for rotating said screens about said axes with concurrent displacement of said substrate for imprinting the latter in different colors according to complementary pattern components formed by the apertures of said screens, the improvement wherein at least some of said screens are provided with axially extending cleansing means contacting the respective screens above the level of their gaps for removing adhering dyestuff from the outer peripheral screen surfaces, said cleansing means including a scraper roll with a resilient surface contacting a descending part of the corresponding outer peripheral screen surface, motion-imparting means for rotating said scraper roll codirectionally with the respective screen whereby said resilient surface moves upwardly adjacent said descending part and carries said adhering matter around the top of said scraper roll, spray means for irrigating the top of said scraper roll with a diluent, a receptacle positioned beneath said scraper roll to receive said adhering matter together with said diluent from said roll, and stripping means contacting a lower portion of said roll between said spray means and said screen for detaching said adhering matter from said resilient surface above the bottom of said receptacle.

* * * * *